United States Patent [19]

Monser

[11] 4,353,072

[45] Oct. 5, 1982

[54] CIRCULARLY POLARIZED RADIO FREQUENCY ANTENNA

[75] Inventor: George J. Monser, Goleta, Calif.

[73] Assignee: Raytheon Company, Lexington, Mass.

[21] Appl. No.: 210,094

[22] Filed: Nov. 24, 1980

[51] Int. Cl.[3] ..... H01Q 13/02

[52] U.S. Cl. ..... 343/725; 343/778; 343/786

[58] Field of Search ..... 343/725, 786, 854, 778

[56] References Cited

U.S. PATENT DOCUMENTS 4,141,012 2/1979 Hockham et al. ..... 343/725

*Primary Examiner*—Eli Lieberman

*Attorney, Agent, or Firm*—Richard M. Sharkansky; Joseph D. Pannone

[57] ABSTRACT

A radio frequency antenna including an antenna element having an open-ended waveguide section coupled to a first feed means for establishing radio frequency energy having linear polarization, the electric field vector of such energy being disposed normal to a pair of opposing wall portions of the waveguide. The antenna element includes a microwave circuit means for establishing radio frequency energy having a linear polarization orthogonal to the polarization of the first mentioned radio frequency energy. The microwave circuit includes a dielectric and a conductive sheet disposed over the dielectric; such sheet providing one of the wall portions of the waveguide section. The conductive sheet has an array of notches formed therein, such notches being disposed adjacent the open end of the waveguide section. A second feed means is coupled to the array of notches for establishing radio frequency energy having a linear polarization, the electric field thereof being in the plane of the dielectric and hence normal to the polarization established by the first feed means. With such arrangement, the first and second feed means are fed in quadrature and the phase centers of the orthogonally disposed polarized radio frequency energy at the open end of the waveguide are substantially coincident to thereby enable the antenna to establish circularly polarized radio frequency energy in free space. Further, the radio frequency energy fed to the second feed means is distributed to an array of notch shaped elements thereby increasing the power handling capability of the antenna element. Still further, the antenna element is relatively compact and suitable to be arranged in relatively wide scan angle coverage.

2 Claims, 13 Drawing Figures

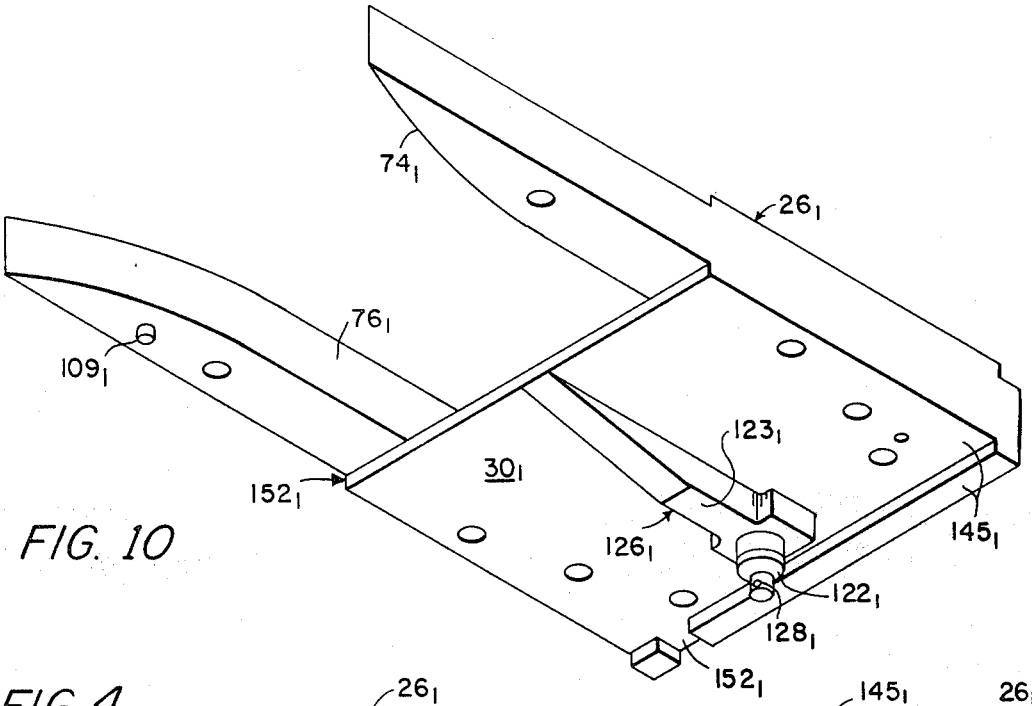
FIG. 10
FIG. 4
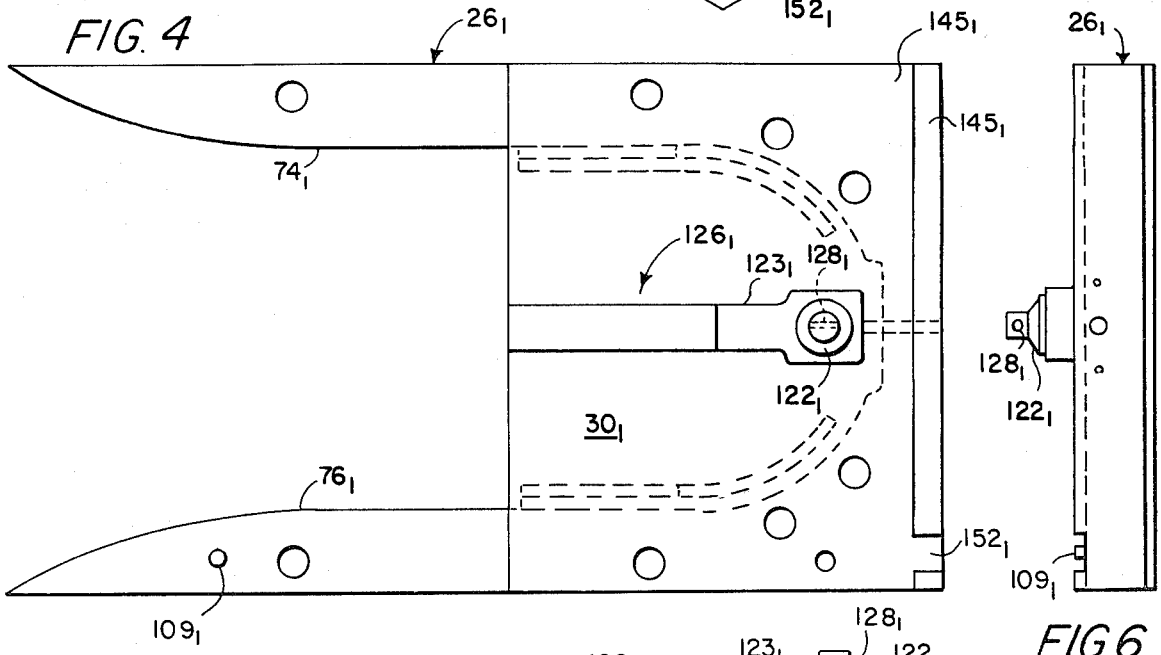
FIG.6
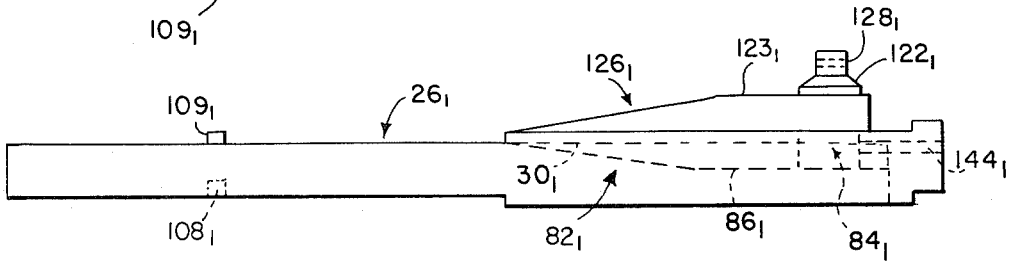
FIG. 5

CIRCULARLY POLARIZED RADIO FREQUENCY ANTENNA

BACKGROUND OF THE INVENTION

This invention relates generally to radio frequency antenna and more particularly to radio frequency antenna adapted to operate with radio frequency energy having any one of a variety of polarizations.

As is known in the art, it is frequently desirable to use an antenna element which may operate with any one of a variety of polarization (i.e. linear or circular). One type of antenna element capable of such operation is sometimes referred to as a "double ridged" horn. One antenna element of such type generally would include a vertical feed and an independent horizontal feed, the phase centers of such feeds being coincident. For circular polarization the two feeds are fed with radio frequency energy having a quadrature phase difference. In order to provide efficient matching to free space over a relatively wide frequency band, say in the order of 3.5 to 1, it is generally required that the width of the horn be larger than half the wavelength at the nominal operating frequency of the antenna and sometimes be as large as one wavelength. In an array antenna, a plurality of antenna elements are provided in order to attain a relatively wide scan angle, say in the order of 120 degrees. In such array, it is generally required that the phase centers of adjacent ones of the plurality of antenna elements be displaced by less than one half wavelength. It follows then that while a double ridged horn antenna may be adapted to operate with radio frequency energy having circular polarization, such an antenna element may not be readily used, because of its size, in an array antenna having relatively wide scan angles.

In another type of array antenna adapted to provide a variety of polarization each one of the antenna elements includes an orthogonally disposed pair of printed circuit notch shaped antenna elements. One such type of antenna is described in U.S. Pat. No. 3,836,976 entitled "Closely Spaced Orthogonal Dipole Array," inventors George J. Monser, George S. Hardie, John R. Ehrhardt and Terry M. Smith, issued Sept. 17, 1974, and assigned to the same assignee as the present invention. While such antenna is adapted to operate with circularly polarized radio frequency energy over relatively wide scan angles and over a relatively wide band of frequencies, such antenna is limited in its power handling capability and hence is not suitable for use in those applications where such antenna is fed by a transmitter adapted to transmit relatively large amounts of power.

SUMMARY OF THE INVENTION

In accordance with the present invention an antenna element is provided having an open ended waveguide section coupled to a first feed means for establishing radio frequency energy having linear polarization, the electric field vector of such energy being disposed normal to a pair of opposing wall portions of the waveguide. The antenna element includes a microwave circuit means for establishing radio frequency energy having a linear polarization orthogonal to the polarization of the first mentioned radio frequency energy. The microwave circuit includes a dielectric and a conductive sheet disposed over the dielectric; such sheet providing one of the wall portions of the waveguide section. The conductive sheet has an array of notches formed therein, such notches being disposed adjacent the open end of the waveguide section. A second feed means is coupled to the array of notches for establishing radio frequency energy having a linear polarization, the electric field thereof being in the plane of the dielectric and hence normal to the polarization established by the first feed means.

With such arrangement, the first and second feed means are fed in quadrature and the phase centers of the orthogonally disposed polarized radio frequency energy at the open end of the waveguide are substantially coincident to thereby enable the antenna to establish circularly polarized radio frequency energy in free space. Further, the radio frequency energy fed to the second feed means is distributed to an array of notch shaped elements thereby increasing the power handling capability of the antenna element. Still further, the antenna element is relatively compact and suitable to be arranged in an array for providing relatively wide scan angle coverage.

BRIEF DESCRIPTION OF THE DRAWINGS

The foregoing features of this invention, as well as the invention itself, may be more fully understood from the description read together with the accompanying drawings, in which:

FIG. 4 is a bottom plan view of the member of FIG. 3;

FIG. 5 is a side elevation view of the member of FIG. 3;

FIG. 6 is an end elevation view of the member of FIG. 3;

FIG. 10 is a perspective view of the bottom portion of the member of FIG. 3;

DESCRIPTION OF THE PREFERRED EMBODIMENT

Figure 1:
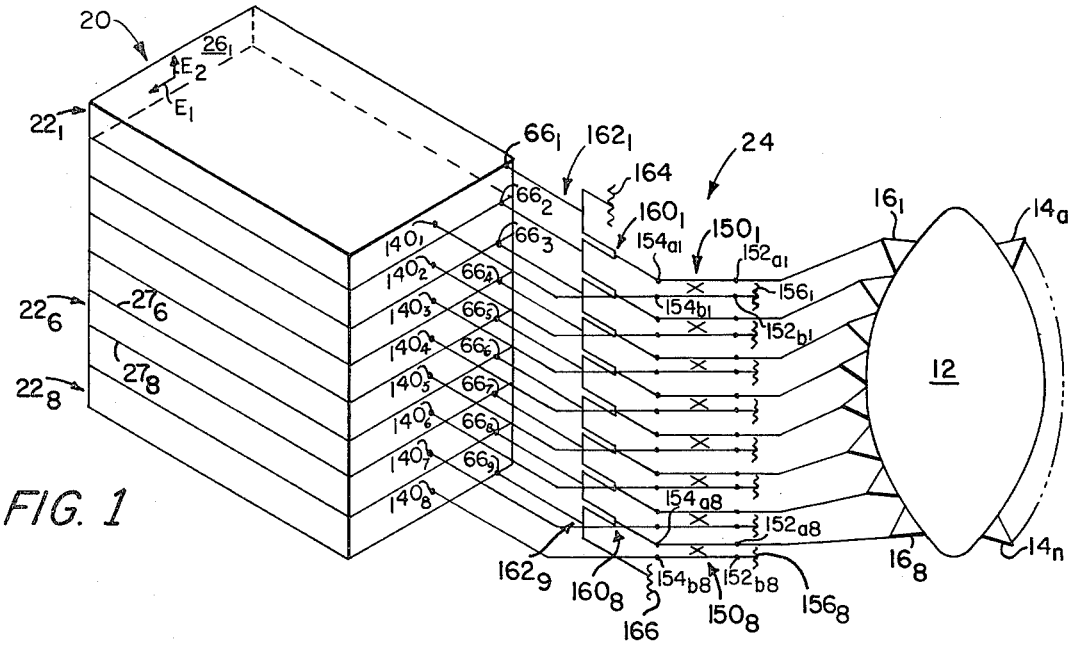
FIG. 1 is a schematic diagram of a radio frequency antenna system including an array of antenna elements according to the invention.

Referring now to FIG. 1 a multibeam radio frequency antenna system 10 adapted to operate over a relatively wide band of frequencies, here 4.8 GHZ to 18.0 GHZ is shown to include a radio frequency lens 12 having a plurality of feed ports 14*a*–14*n* disposed along a portion of the periphery of such lens 12 and a plurality of here eight array ports $16_1$–$16_8$ disposed along an opposing portion of the periphery of the lens 12, the plurality of array ports $16_1$–$16_8$ being coupled to an array 20 of a plurality of, here eight, identically constructed antenna elements $22_1$–$22_8$ through a power distribution network 24 the details of which will be described hereinafter. Sufficient to say here, however, that the shape of the lens 12, the construction of the power distribution network 24 and the arrangement of the antenna elements $22_1$–$22_8$ are selected such that n collimated beams of radio frequency energy are formed in free space by the antenna system 10, each one of such n beams having a different direction and each one of such n beams having circularly polarized radio frequency energy.

Figure 12:
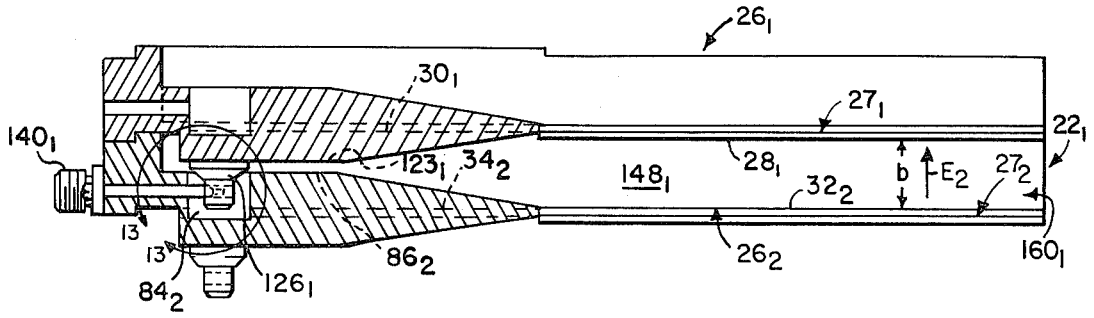
FIG. 12 is a cross-sectional side elevation view of the antenna element of FIG. 11.
Figure 2:
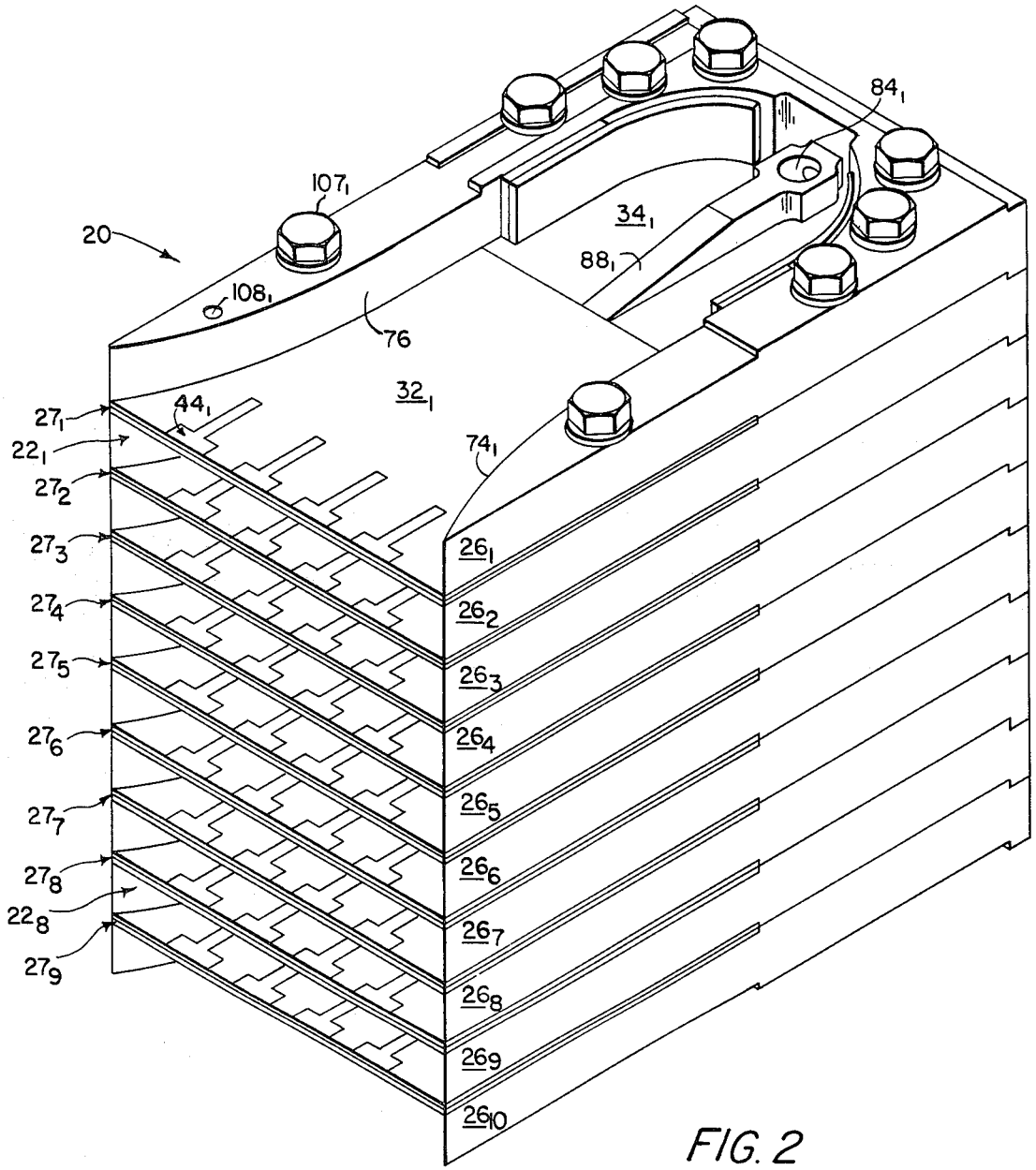
FIG. 2 is a perspective view of the array of antenna elements used in the antenna system of FIG. 1.
Figure 3:
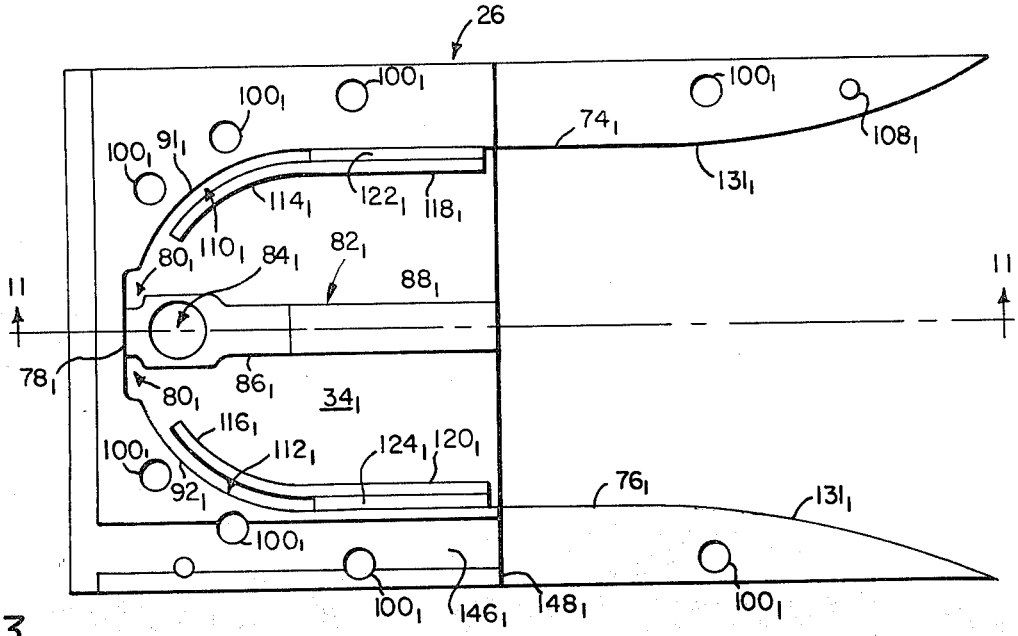
FIG. 3 is a top plan view of a member used to form a portion of one of the antenna elements of FIG. 2.
Figure 11:
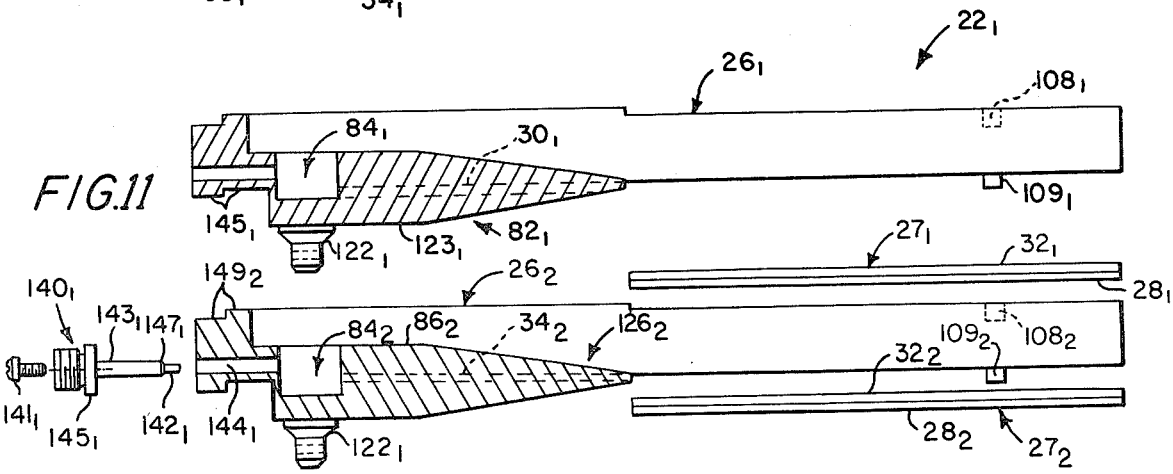
FIG. 11 is an exploded cross-sectional side elevation view of a pair of members of FIG. 3 and a pair of strip transmission line networks of FIG. 7, such pair of feed networks, and pair of members forming the antenna element of FIG. 9, the cross-section of one of such members being taken along lines 11—11 of FIG. 3, one of such pair of members being the member shown in FIG. 3.
Figure 7:
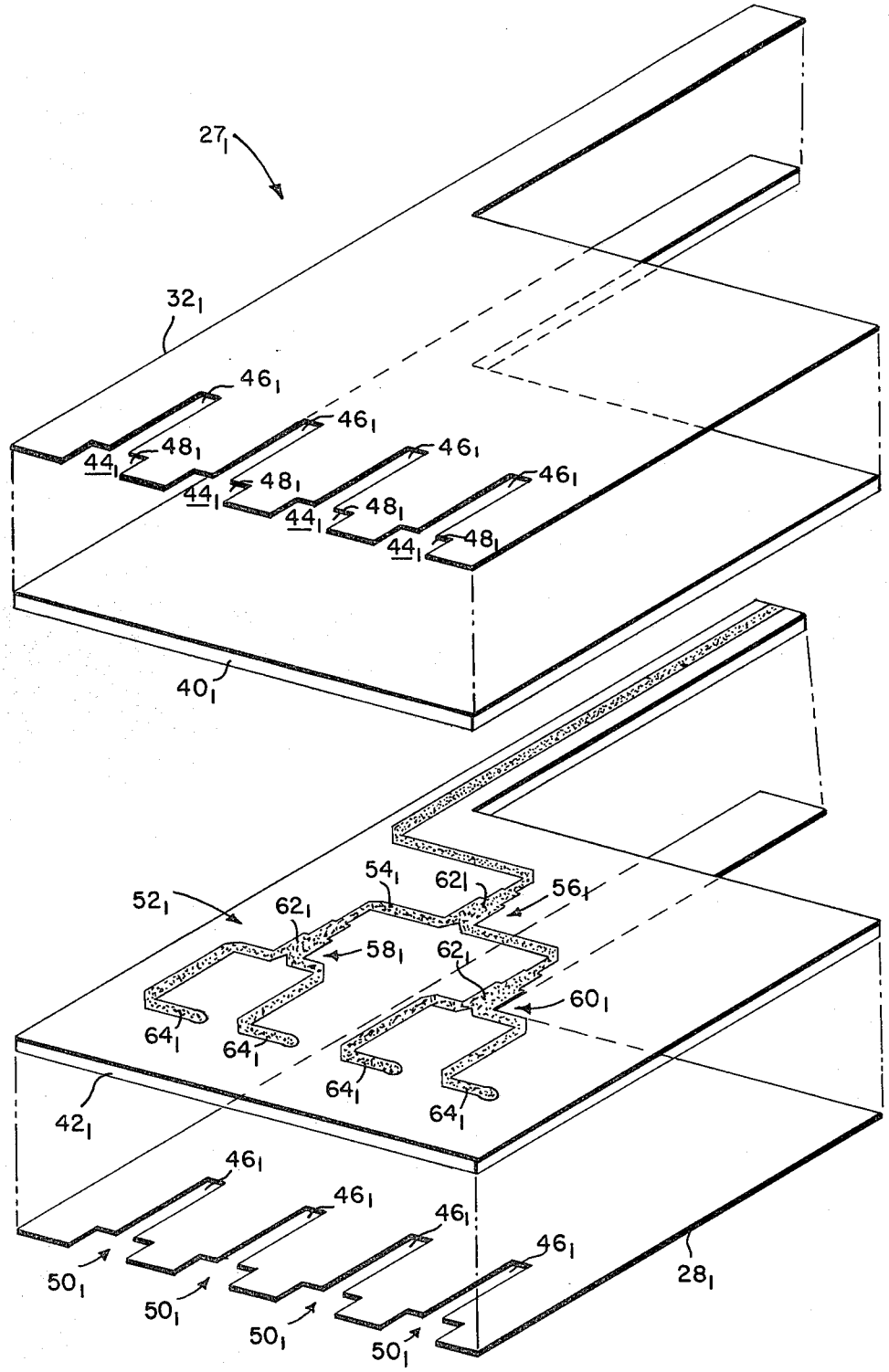
FIG. 7 is an exploded, isometric view of a strip transmission line feed network used to form a portion of one of the antenna elements of FIG. 2.
Figure 9:
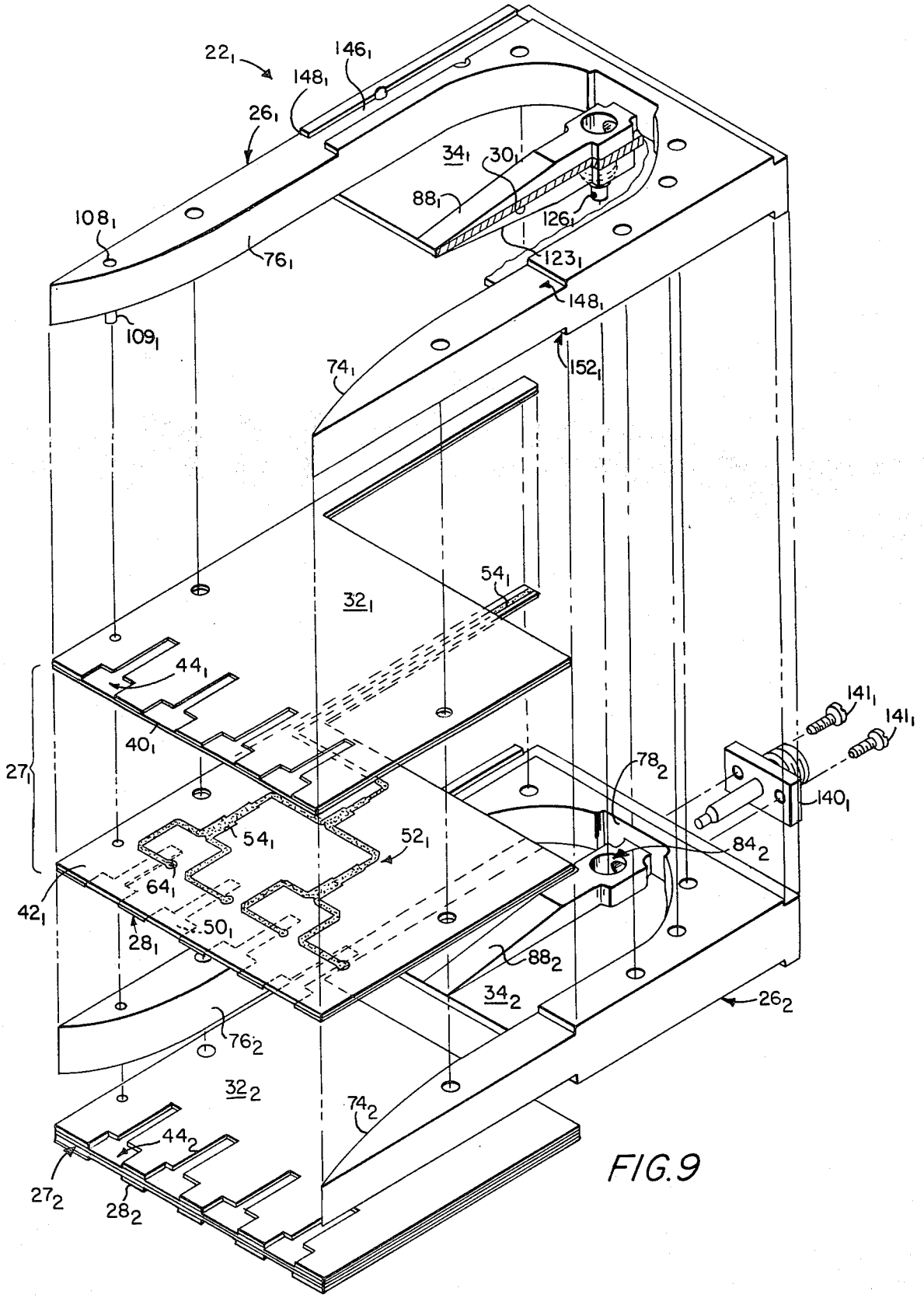
FIG. 9 is an exploded isometric drawing, partly broken away, of one of the antenna elements in the array of FIG. 2.

Referring to FIG. 2 array 20 is shown to include a plurality of identically constructed conductive members $26_1$–$26_{10}$, an exemplary one thereof, here member $26_1$ being shown in detail in FIGS. 3–6 and 10 and a plurality of, here nine, identically constructed microwave circuits, here strip transmission line circuits $27_1$–$27_9$, an exemplary one thereof, here circuit $27_1$ being shown in detail in FIG. 7. A pair of members $26_1$–$26_{10}$ and a pair of circuits $27_1$–$27_9$ form one of the identically constructed antenna elements $22_1$–$22_8$. Thus, as shown FIGS. 9, 11 and 12 an exemplary one of the antenna elements $22_1$–$22_8$, here antenna element $22_1$ is shown to include conductive members $26_1$ and $26_2$ and strip transmission line circuits $27_1$ and $27_2$. (It is noted that constituent parts of member $26_1$ and circuit $27_1$ are designated by a subscript 1 and constituent parts of member $26_2$ and circuit $27_2$ are designated by a subscript 2). More particularly, as shown in FIGS. 9, 11 and 12, the upper surface of the antenna $22_1$, is formed, in the frontal portion thereof, by the bottom surface $28_1$ of strip transmission line circuit $27_1$ and in the rearward portion thereof by the bottom surface $30_1$ of conductive member $26_1$; whereas the lower surface of antenna elements $22_1$ is formed, in the frontal portion thereof, by the upper surface $32_2$ of strip transmission line circuit $27_2$ and, in the rearward portion thereof, by the upper surface $34_2$ of conductive member $26_2$.

Figure 8:
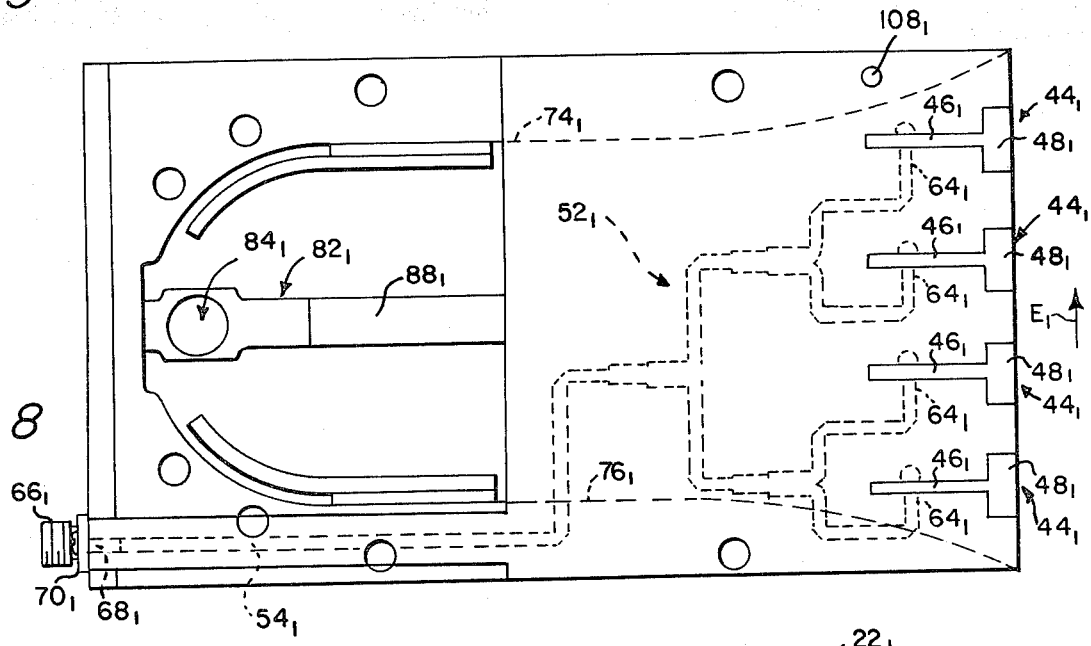
FIG. 8 is a plan view of the member of FIG. 3 and the strip transmission line feed network of FIG. 7 disposed thereon.

Referring now to FIG. 7 an exemplary one of the identically constructed strip transmission line circuit $27_1$–$27_9$, here strip transmission line circuit $27_1$ is shown in detail to include a pair of dielectric support structures $40_1$, $42_1$ of any suitable material, here Teflon Fiberglas material having a dielectric constant of 2.56. Initially, each one of the dielectric support structures $40_1$, $42_1$ has a sheet of conductive material, here copper clad on the upper and lower surfaces thereof. The sheet of conductive material on the lower surface of dielectric support structure $42_1$ is removed entirely with a suitable chemical etchant whereas a plurality of, here four, flared notches $44_1$ are etched into the conductive material $32_1$ clad onto the upper surface of such dielectric support structure $40_1$ using conventional photolithographic-chemical etching techniques. Each one of the notches $44_1$ has a narrow portion $46_1$ and a wider portion $48_1$. The notches 44 are separated from each other a distance less than a half wavelength at the smallest operating wavelength of the antenna. More particularly, here the center-to-center spacing of the notches 44 is 0.350 inches. The width of the wide portion 48 is here 0.260 inches and the widths of the narrow portion 46 is here 0.050 inches. The length of the wide portion 48 is here 0.130 inches and the length of the narrow portion 46 is here 0.842 inches. Considering now the second one of the pair of dielectric support structure $42_1$ a similar pattern of four flared notches $50_1$ is etched into the conductive sheet $28_1$ clad to the bottom surface of such dielectric support structure $42_1$. Each one of the slots $50_1$ is identical to the slots $44_1$ formed on the conductive sheet $32_1$ clad to the upper surface of dielectric support $40_1$. The conductive sheet clad to the upper surface of the dielectric support structure $42_1$ is etched to form a feed network $52_1$. The feed network $52_1$ is a strip transmission line circuit having strip conductor $54_1$ disposed between a pair of ground plane conductors formed by the conductive sheets $28_1$, $32_1$, and separated from such sheets $28_1$, $32_1$ by the dielectric support structures $40_1$, $42_1$. The feed network $52_1$ includes a first two-to-one power divider section $56_1$ the output of which into turn feeds a pair of two-to-one power divider sections $58_1$, $60_1$. Each one of the three power divider sections $56_1$, $58_1$, $60_1$ includes a step-matching transformer section $62_1$. Thus, power fed to the strip transmission line feed network $52_1$ is divided equally, and in phase, to each one of four feed lines $64_1$. Each feed line $64_1$ is disposed underneath the narrow portions $46_1$ of a pair of notches $48_1$, $50_1$ as shown in FIG. 8, the notches $44_1$ on conductive sheet $32_1$ being in registration with the notches $50_1$ formed in conductive sheet $28_1$. When strip transmission line feed network $54_1$ is fed radio frequency energy from a coaxial connector $66_1$ (FIG. 8) having a center conductor $68_1$ electrically connected to a strip conductor $54_1$ of the strip transmission line feed network $52_1$, $54_1$ and outer conductors $70_1$ electrically connected to conductive sheets $32_1$, $28_1$, the strip transmission line circuit $27_1$ couples energy to the feed lines $64_1$ and then to notches $44_1$ and $50_1$ whereupon such feed energy is then radiated into free space with an electric field vector disposed in the plane of the strip transmission line circuit $27_1$ as shown by the vector $E_1$ in FIGS. 1 and 8. Thus, the energy radiated by the notches $44_1$, $50_1$ is linearly polarized; more particularly, here horizontally polarized.

Referring now in more detail to members $26_1$–$26_{10}$, each one of such members $26_1$–$26_{10}$ is constructed from a block of electrically conductive material, here aluminum, here having outer dimensions of 4.037 inches (length) and 2.250 inches (width). Such block has machined therein S-shaped side wall portions $74_1$, $76_1$ (FIG. 3) and a rear wall portion $78_1$ having a recess notch or $80_1$ formed therein. The depth of the side wall and rear wall portions is here substantially 0.325 inches. Also machined into the upper surface $34_1$ of the member $36_1$ is a tapered ridge $82_1$, as shown, here having a width of 0.20 inches. The tapered ridge $82_1$ has an aperture $84_1$ formed in the upper, flat top portion $86_1$ thereof, the flat top portion $86_1$ terminating in a tapered portion $88_1$, (FIGS. 3, 9) as shown. The length from the end of the tapered ridge $82_1$ to the end of the member 36 is here 2.2 inches. The length of the tapered portion $88_1$ is here 0.9 inches. The depth of the notch $80_1$ formed in the rear wall portion $78_1$ is here 0.075 inches, such notch $80_1$ having a length along the rear wall portion $78_1$ of, here, 0.588 inches. It is noted that the separation between the side wall portions $74_1$, $76_1$ disposed laterally to the tapered portion $88_1$ is relatively constant, here 1.5 inches; however, such separation decreases, here along curved paths, $90_1$, $92_1$, as such rear wall portions $74_1$, $76_1$ extend towards the rear wall portion $78_1$. As will be discussed in more detail hereinafter, the converging of the side wall portions $74_1$, $76_1$ as they extend towards the rear wall portion $78_1$ in the region behind the aperture $84_1$ (such aperture being the area where the antenna element $22_1$ formed by such member $26_1$ together with member $26_2$ is fed by the coaxial connector in a manner to be described) improves the impedance matching between the coaxial connector and the antenna element $22_1$. Member $26_1$ also has holes $100_1$ drilled through it, such being used for bolting the members together with bolts and screws $107_1$ as shown in FIG. 2. A hole $108_1$ is formed partly into the upper surface of the member $26_1$ and is used to receive an alignment pin $109_2$ (FIGS. 4–6) formed on the bottom surface of member $26_2$, as shown also in FIG. 10. Disposed along the curved regions $90_1$, $92_1$ (FIG. 3) of the side wall portions $74_1$, $76_1$ are open ended channels $110_1$, $112_1$. Channels $110_1$, $112_1$ are here formed of curved conductive strips $114_1$, $116_1$ here aluminum, having ends $118_1$, $120_1$ spaced from, and affixed to, side walls $74_1$, $76_1$ respectively. The spacing is provided by aluminum spacers $122_1$, $124_1$ such ends $118_1$, $120_1$ and spacers $122_1$, $124_1$ being affixed to the side wall portions $74_1$, $76_1$ through any convenient means as by bolts or a suitable electrically conductive epoxy, not shown. The spacers $122_1$, $124_1$ here have a thickness of 0.1 inches and the length of the channels $110_1$, $112_1$ is here 0.6 inches. The channels $110_1$, $112_1$, are effective in removing unwanted surface currents produced along the side wall portions $74_1$, $76_1$ such currents being associated with radio frequency energy having a frequency of here 13.2 GHZ. That is, it was noted that there was a significant loss of gain the antenna at about 13.2 GHZ. It was also noticed that the channels $110_1$, $112_1$ removed the loss of gain in the region of 13.2 GHZ. It is noted that the length of the channels $110_1$, $112_1$ is here about three quarters of the wavelength of the frequency associated with the unwanted surface currents.

The side wall portion $74_1$, $76_1$ (FIG. 3) disposed between the tapered ridge $82_1$ and the frontal end of the member $26_1$ are flared outwardly along a nonlinear path $131_1$ to increase the surface length of the side wall portions $74_1$, $76_1$ from the tapered ridge $82_1$ to free space within the fixed longitudinal length of the antenna element $26_1$ thereby providing a relatively compact antenna element with a side wall length sufficiently long to provide an adequate transition region between the tapered ridge and free space.

Figure 13:
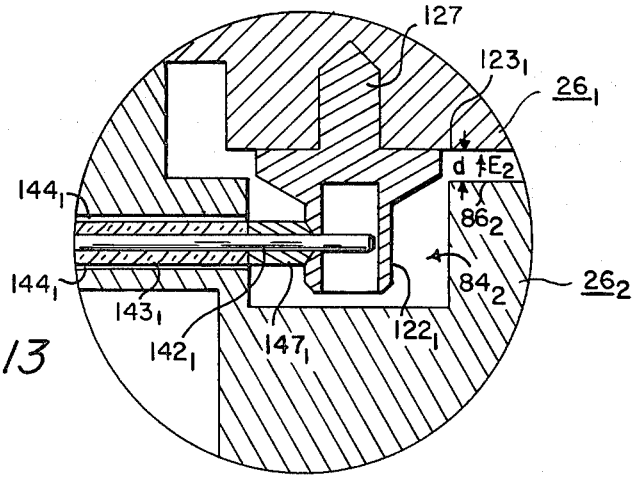
FIG. 13 is a cross-sectional view showing a portion of a feed probe used to feed the portion of the antenna element of FIG. 12 formed by the pair of members and also showing a portion of such pair of members, such FIG. 13 being of region 13—13 of FIG. 12.

Referring now to the bottom surface $30_1$ of member $26_1$ (shown more clearly in FIGS. 4, 5, 6 and 10) such surface $30_1$ also has a tapered ridge $126_1$ formed thereon; here, however the flat portion $123_1$ of the ridge $126_1$ has a turret shaped conductive post $122_1$ (here shown) press fit therein by a pin shaped end $127_1$ as shown in FIG. 13. Post $122_1$ has a hole $128_1$ drilled therein as shown for receiving the center conductor $142_1$ of a coaxial connector $140_1$ (FIG. 11) in a manner to be described in detail in connection with FIG. 13. It is noted from FIG. 5 that the tapered ridges $82_1$, $126_1$ formed on the upper and lower surfaces of member $26_1$ are in alignment or registration with each other. Further, it is evident that the post $122_1$ of member $26_1$ fits into the aperture $84_2$ of member $26_2$ as shown in FIGS. 9, 11 and 12.

When members $26_1$, $26_2$ and strip transmission line circuits $27_1$, $27_2$ are affixed together (here by screws 107 (FIG. 2) and conductive epoxy, not shown, disposed on the portions of the copper conductive sheets 28, 32 of circuits $27_1$–$27_9$ (FIGS. 9 and 10) which contact portions of the conductive members $26_1$–$26_{10}$), the lower surface $30_1$ of member $26_1$, and the upper surface $34_2$ of member $26_2$ form opposing upper and lower wide surfaces of the rear portions of a hollow rectangular, open ended waveguide structure; the bottom ground plane conductor $28_1$ of circuit $27_1$ and the upper ground plane conductor $32_2$ of circuit $27_2$ form opposing upper and lower wide wall portions of the forward portion of the rectangular waveguide structure and side wall portions $74_2$, $76_2$ and rear wall portion $78_2$ form narrow side and rear walls of such open ended, rectangular waveguide. More particularly, the affixed members $26_1$, $26_2$ formed a tapered ridge rectangular waveguide antenna element $22_1$. Surfaces $145_1$ of member $26_1$ contact surfaces $149_2$ of member $26_2$ as shown in FIG. 11. The side and back edges of the circuits $27_1$–$27_9$ are covered with a conductive epoxy (not shown) to electrically connect the side and back edges of the conductive sheets 28, 32. Further, circuits $27_1$, $27_2$ (FIG. 3) fit into a groove $146_1$, $148_1$, $152_1$ formed in the conductive members $26_1$–$26_8$ so that the flat portions $86_2$, $123_1$ of the ridges $126_2$, $82_1$ are separated a distance "d" (FIG. 13), and the wide walls of the waveguide, i.e. conductive sheets $28_1$, $32_2$, are separated a distance "b" (FIG. 12). The distances "b" and "d" are designed so that the waveguide propagates even in the $TE_{10}$ mode. Here "d" is 0.045 inches and "b" is 0.325 inches. The tapered ridge waveguide antenna elements $22_1$–$22_8$ are fed by the coaxial transmission line through coaxial connectors $140_1$–$140_8$ (FIGS. 1, 9, 11 and 12) having a center conductor $142_1$ (FIG. 13) passing through hole $144_1$ (FIGS. 5, 11, 13) and the end of such center conductor $142_1$ press fit to post $122_1$ to provide electrical and mechanical contact to post $122_1$. The outer conductor $145_1$ is electrically and mechanically connected to the member $26_2$ through screws $141_1$ as shown in FIGS. 9 and 11. The inner conductor $142_1$ is separated from the walls of the hole $144_1$ by a dielectric sleeve $143_1$ as shown in FIG. 13. A ferrite ring $147_1$ is disposed around the inner conductor $142_1$ between the dielectric $143_1$ and the post $126_1$, as shown in FIG. 13 to provide impedance matching between the coaxial connector $142_1$ and the post $122_1$. Radio frequency energy fed to the antenna element $26_1$ via connector $140_1$ thus launches radio frequency energy into cavity $148_1$ (FIG. 12), such energy travelling towards the open end $160_1$ of the cavity in the $TE_{10}$ mode having an electric field vector extending between the wide surfaces of the waveguide as shown by arrow $E_2$ in FIGS. 1 and 12.

It is noted then that each one of the antenna elements $22_1$–$22_8$ is adapted to transmit radio frequency energy having vertical polarization, (as when feeding radio frequency energy to connector $140_1$–$140_8$ or horizontally polarized radio frequency energy (as when feeding radio frequency energy to connector $66_1$–$66_9$). Further, if radio frequency energy is fed equally to both connectors $140_1$–$140_8$ and $66_1$–$66_9$ and the phase of the energy fed to such connectors differs by ninety degrees, such antenna element will transmit circularly polarized radio frequency energy in free space.

Thus, referring again to FIG. 1 the details of the power distribution network 24 will now be described.

As mentioned above in connection with FIG. 1 the array ports $16_1$–$16_8$ are coupled to the array 20 through a power distribution network 24. The power distribution network 24 includes a plurality of, here eight, hybrid couplers, $150_1$–$150_8$ having a pair of input terminals $152a_1$, $152b_1$–$152a_8$, $152b_8$ and a pair of output terminals $154a_1$, $154b_1$–$154a_8$, $154b_8$. One of the input terminals $152a_1$–$152a_8$ is coupled to a corresponding one of the array ports $16_1$–$16_8$, as shown and the other one of such input $152b_1$–$152b_8$ terminals is terminated in a matched load $156_1$–$156_8$ as shown. Hence the power fed to the couplers $150_1$–$150_8$ is divided equally between output ports $154a_1$, $154b_1$, through $154a_8$, $154b_8$ respectively, but the signals at such output ports differ in phase from one another by ninety degrees. That is, considering coupler $150_1$ for example, the signals at output ports $154a_1$, $154b_1$ differ in phase by ninety degrees. The signals produced at ports $154a_1$–$154a_8$ are fed to two-to-one power dividers $160_1$–$160_8$, respectively as shown. The power in the signals fed to dividers $160_1$–$160_8$ is divided equally and in phase. The pair of signals produced at the outputs of dividers $160_1$–$160_8$ are fed to two-to-one power combiners $162_1$–$162a_1$ as shown. It is noted that one of the inputs of combiners $162_1$, $162_9$ are terminated in matched loads 164, 166. The outputs of power combiners $162_1$–$162_9$ are fed to coaxial connectors $66_1$–$66_9$ which feed strip transmission line circuits $27_1$–$27_9$. Thus, if the radio frequency signal phases at output ports $154a_1$–$154a_8$ are represented as: $\phi$, $2\phi$, . . . $8\phi$ respectively, the signal phases at connectors $66_1$–$66_9$ may be represented as: $\phi/2$, $3\phi/2$, $5\phi/2$ . . . $15\phi/2$, $17\phi/2$, respectively and the signal phases at connectors $140_1$–$140_8$ may be represented as: $\phi+(\pi/2)$ . . . $8\phi+(\pi/2)$ respectively.

Considering first an exemplary pair of the pair of inner connectors $66_2$, $66_3$ through $66_7$, $66_8$, here for example the pair of connectors $66_6$, $66_7$ it is noted that such connectors feed the strip transmission line circuits $27_6$, $27_8$ which form a portion of the upper and lower wide walls of the antenna element $22_6$. Further, the signal phases fed to such terminals $27_6$, $27_8$ may be represented as: $11\phi/2$ and $13\phi/2$ respectively. Therefore, in the region between the circuits $27_6$, $27_8$ at the open end of the antenna element $26_6$, the signals combine so that the resulting signal phase may be represented as: $6\phi$ in the region between the circuits $27_6$, $27_8$. Further, such signal has a horizontal polarization. Still further, the signal phase fed to connector $140_6$ of such antenna element $22_6$ may be represented as: $6\phi+(\pi/2)$, has a vertical polarization, and has a phase center coincident with the phase center of the horizontally polarized energy of the signal produced by the pair of strip transmission line circuits $27_6$, $27_8$. Thus, the energy associated with antenna element $22_6$, in free space, is circularly polarized. It is noted that the above discussion applies to antenna elements $22_2$–$22_7$, however there is some distortion with the antenna elements $22_1$, $22_8$ which are at the end of the array 20. However, with a large array, i.e. an array having 16 elements or more the effect of the end elements is minimized.

Having described a preferred embodiment of the invention it will now be apparent to one of skill in the art that other embodiments incorporating its concept may be used. It is believed therefore that this invention should not be restricted to the disclosed embodiment but rather should be limited only by the spirit and scope of the appended claims.

What is claimed is:

1. A radio frequency antenna for producing circularly polarized radio frequency energy comprising:

(a) a waveguide section having a pair of opposing walls;

(b) a first feed means for establishing radio frequency energy in such waveguide section having a linear polarization with an electric field disposed normal to the pair of opposing walls of the waveguide;

(c) a first microwave circuit means for establishing radio frequency energy having a linear polarization disposed normal to the electric field of the first mentioned linear polarization, such microwave circuit means comprising: a dielectric; a strip conductor circuit disposed over a first surface of the dielectric; and a ground plane conductor disposed over a second opposite surface of the dielectric, such ground plane providing one of the pair of opposing walls of the waveguide;

(d) a second microwave circuit means for establishing radio frequency energy having a linear polarization disposed normal to the electric field of the first mentioned linear polarization, such microwave circuit means comprising: a second dielectric; a second strip conductor circuit disposed over a first surface of the second dielectric; and a second ground plane conductor disposed over a second surface of the second dielectric, such second ground plane conductor providing the second one of the pair of opposing walls of the waveguide section; and, (e) a power distribution means for coupling radio frequency energy to the first and second microwave circuit means with equal power and equal phase shift and for coupling radio frequency energy to the first feed means with a phase shift 90° with respect to the phase shift of the energy fed to the first and second microwave circuit means.

2. The antenna recited in claim 1 wherein the ground plane conductor of the one of the microwave circuit means includes a plurality of notch radiating elements formed therein and a feed network for distributing the microwave energy fed thereto between each one of the plurality of notch radiating elements.

* * * * *